United States Patent [19]

Bowman

[11] Patent Number: 4,457,138

[45] Date of Patent: Jul. 3, 1984

[54] REFRIGERATION SYSTEM WITH RECEIVER BYPASS

[75] Inventor: Edward E. Bowman, Niles, Mich.

[73] Assignee: Tyler Refrigeration Corporation, Niles, Mich.

[21] Appl. No.: 343,931

[22] Filed: Jan. 29, 1982

[51] Int. Cl.[3] ..... F25B 39/04

[52] U.S. Cl. ..... 62/196.1; 62/509; 62/DIG. 17

[58] Field of Search ..... 62/196 R, 509, 117, 62/DIG. 17

[56] References Cited

U.S. PATENT DOCUMENTS

| | | | |
|---|---|---|---|
| 2,874,550 | 2/1959 | Musson | 62/DIG. 17 |
| 3,093,976 | 6/1963 | Walcutt | 62/509 X |
| 3,145,543 | 8/1964 | Miner | 62/509 X |
| 3,844,131 | 10/1974 | Gianni et al. | 62/196 R |

*Primary Examiner*—William E. Wayner

*Attorney, Agent, or Firm*—LeBlanc, Nolan, Shur & Nies

[57] ABSTRACT

A closed circuit refrigeration system includes a compressor, a remote condenser coupled to the output of the compressor, a receiver tank coupled downstream of the condenser means, and one or more evaporators coupled between the receiver and compressor return. A bypass conduit is coupled between the condenser output and receiver input at one end and between the receiver output and evaporator input at the other end; and a temperature controlled valve selectively controls the flow of refrigerant through the bypass conduit as a function of the temperature of refrigerant at the condenser output. A check valve in the condenser output conduit prevents backflow of refrigerant during periods of low condenser pressure. A method of operating a closed circuit refrigeration system is included in which a receiver tank bypass line is controlled responsive to the condition of the refrigerant in the condenser output.

22 Claims, 1 Drawing Figure

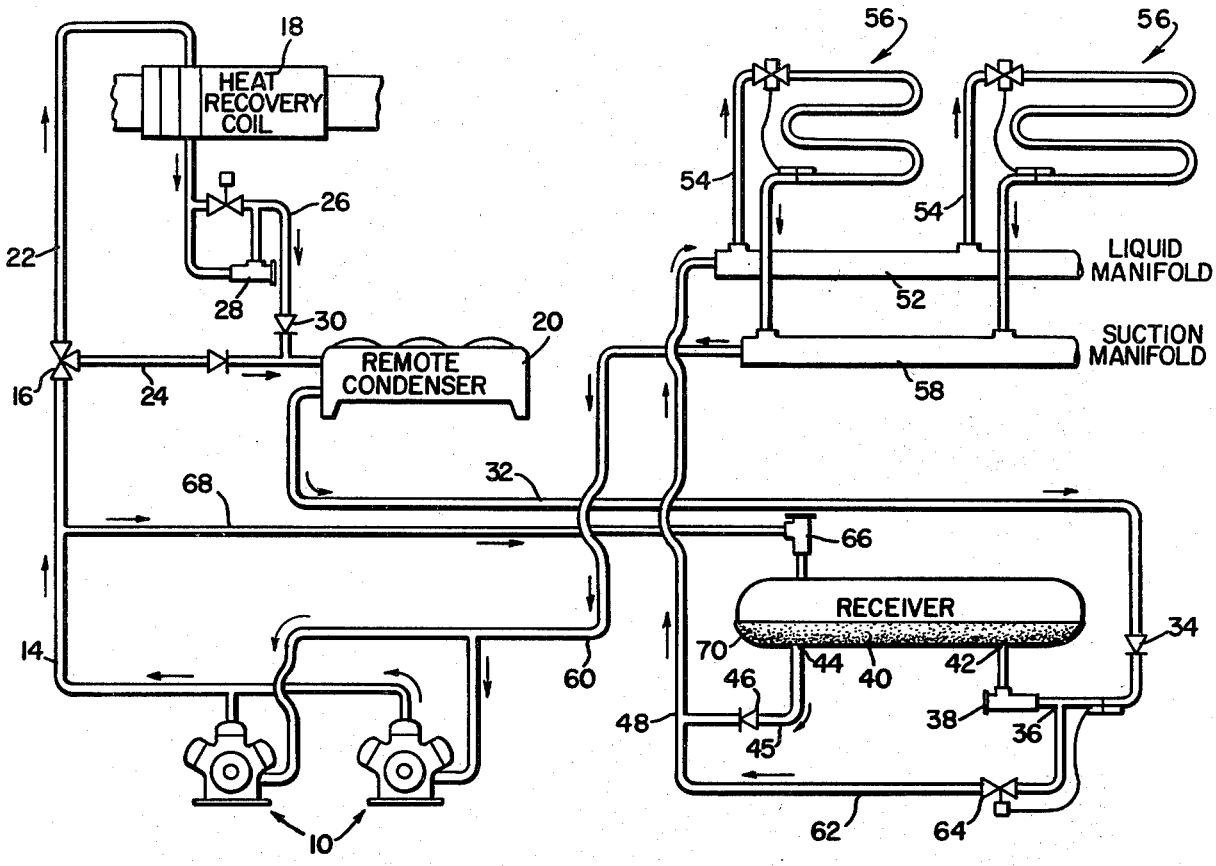
HEAT RECOVERY COIL
REMOTE CONDENSER
LIQUID MANIFOLD
SUCTION MANIFOLD
RECEIVER
18
26
22
28
30
20
16
24
56
56
54
54
52
58
32
68
66
34
14
70
44
40
42
60
46
48
45
38
36
62
64
10

REFRIGERATION SYSTEM WITH RECEIVER BYPASS

BACKGROUND OF THE INVENTION

The present invention relates to a closed cycle refrigeration system utilizing a remote condenser and constructed so as to improve the efficiency of operation of the system and reduce the power consumption.

In the basic construction and operation of a closed cycle refrigeration system, gaseous refrigerant, e.g., freon, is compressed to a high temperature and pressure. The compressed gas is passed to a condenser where it is condensed to a liquid phase. The pressure within the condenser is maintained high enough that the condensing temperature is higher than the ambient air temperature. The liquid refrigerant may be temporarily stored in a receiver before being passed, through a metering device to reduce the liquid refrigerant pressure, to an evaporator located within a display case. As the liquid passes through the evaporator, it extracts heat from the display case and undergoes a phase change to the gaseous state. This low pressure gaseous refrigerant is supplied to the input side of the compressor where it is heated and compressed to a high pressure and the cycle is continued.

Traditionally, the condenser was operated at a preselected design temperature level. The design temperature for the condenser was generally determined as a function of the highers ambient temperature during a normal period of the warmest season in a particular area. The condenser was operated so as to condense the gaseous refrigerant at a temperature of at least 10° F. above this design temperature. Consequently, if the design temperature was 90° F., then the condenser temperature was set at 100° F.

Recognizing that the design temperature was only likely to occur a few days in a year, and then only during the day and not at night, the refrigeration systems have been modified so that the condenser temperature followed the path of the ambient temperature while always remaining at least 10° F. above the ambient temperature. Varying the condenser temperature to follow ambient conditions results in increased compressor capacity. The rule of thumb is that every 10° F. drop in the condenser temperature increases the compressor capacity by about 6%. Thus, if the condenser temperature drops from 100° to 75°, the compressor capacity will increase by about 15%. Simultaneously, the compressor consumption will be reduced, the compressor efficiency will increase, and the BTU/Watt of the compressor will increase. The combination effect is to increase compressor capacity and reduce power consumption, assuming constant refrigeration load. If the condenser temperature drops from 100° to 75°, for example, consumption is reduced by almost 20%, assuming a constant refrigeration load.

During the operation of the refrigeration systems, it is necessary to regulate the pressure within the receiver in order to ensure proper operation of the evaporators. Such regulation has typically been provided by shunting hot gaseous refrigerant from the gas discharge line of the compressor directly into the receiver whenever the relative pressure of the receiver drops by more than a preselected pressure differential from the pressure in the gas discharge conduit. For such purposes, a check valve, typically set to respond to a pressure difference on the order of 20 or 30 psi, has been provided in the line between the gas discharge conduit and the receiver. Hence whenever the pressure within the receiver drops by more than 20 or 30 psi as compared to the pressure in the gas discharge conduit the check valve opens and allows the hot gas from the gas discharge line to flow directly into the receiver. Since the gaseous refrigerant in the gas discharge conduit is typically of a temperature level of approximately 200° F., such gas acts as a significant heat source to the receiver, a situation which is generally undesirable.

During the refrigeration cycle, the refrigerant absorbs a substantial amount of heat during the evaporation stage, which heat is then dissipated by the condenser as a waste by-product of the refrigeration cycle. A technique for taking advantage of the heat to be dissipated by the hot gaseous refrigerant is the utilization of a heat recovery coil, such as shown in U.S. Pat. No. 4,123,914 issued Nov. 7, 1978, to Arthur Perez and Edward Bowman, and commonly assigned with the present invention. The disclosure of the Perez et al. '914 patent is incorporated herein by reference. Such a heat recovery coil allows for extraction of heat from the gaseous refrigerant flowing out of the compressor before entering the remote condenser. Such extracted heat then can be utilized for heating the interior of the building where the refrigeration system is employed.

Especially in recent years, much attention has been directed to improving the efficiency of such refrigeration systems. The prior art is replete with discussions of various techniques for attempting to improve the operation of a refrigeration system. In large installations, such as supermarkets, there are typically large numbers of refrigerated display cases and a plurality of compressors are used to satisfy the heavy refrigeration load under certain conditions, such as during the warmer portions of the year. The efficiency of the compressors is dependent upon the compression ratio of the discharge side of the compressor to the suction side of the compressor. Thus, by reducing the head pressure at the compressor discharge, the efficiency of the operation of the compressor can be increased. One such system, employing reduced head pressure to increase operating efficiency, is described in copending application Ser. No. 57,350, filed July 13, 1979, now U.S. Pat. No. 4,286,437 titled ENERGY SAVING REFRIGERATION SYSTEM and commonly assigned with the present invention; the disclosure of said Ser. No. 57,350, now U.S. Pat. No. 4,286,437 is hereby incorporated by reference as though fully set forth herein.

One of the features of the low head pressure systems, particularly including the one described in the aforesaid application Ser. No. 57,350, now U.S. Pat. No. 4,286,437 is that the system is designed to subcool liquid refrigerant in the remote condenser. Liquid subcooling will increase the efficiency of the system since the refrigerant will extract 15–25% more heat per pound circulated. The rule of thumb is that for every 10° F. subcooling the system efficiency will increase by 5%. In substantially all commercial refrigeration systems, a receiver tank or surge tank is interposed between the condenser output and the liquid manifold supplying the evaporator coil. It has been found that, in systems employing a receiver tank, the refrigeration loses 10° to 15° F. of subcooling in passing through the receiver; that is, the temperature of the refrigerant in the receiver may rise 10° to 15° F. This results in a loss of efficiency since fewer BTU's of heat can be extracted from the air around the evaporator coils in the display case for each pound of refrigerant passing through the evaporator coil. One reason for this heat gain is that the receiver tank is generally located in the machinery room adjacent the compressor motors and related heat producing equipment. The temperature in the machinery room will usually be higher then the outside ambient temperature. Some of this heat will be absorbed by the refrigerant in the receiver and the temperature of the refrigerant will rise accordingly.

Some commercial refrigerating systems attempt to avoid the problem of receiver tank heat gain by using a surge tank; one such surge tank system is shown in U.S. Pat. No. 3,905,202 issued Sept. 16, 1975 to Donald F. Taft et al. In a surge tank type of system, condensed liquid refrigerant flows directly from the condenser output to the case evaporators. The surge tank stores excess liquid refrigerant to assure continued operation under varying ambient conditions which result in a variation in the condensing capacity of the condensers. It has been found that, especially during hot weather operations, the closed circuit system may "die" because the surge tank pressure may run 35 to 40 psig lower than the condenser pressure, resulting in liquid refrigerant logging in the receiver and not being passed to the evaporator. This problem is particularly prone to occur during periods of abnormally high ambient temperature; at such times, the rated design temperature of the condenser will be exceeded and the condenser will be unable to completely condense the refrigerant. The refrigerant will thus tend to collect and be condensed in the surge tank, creating a pressure drop upstream of the evaporators.

The present invention constitutes an improvement over prior art receiver tank and surge tank systems. The present invention incorporates a bypass conduit which permits subcooled liquid refrigerant to flow directly from the condenser to the evaporator coils under normal temperature conditions without first passing through the receiver tank.

In one embodiment of the present invention, the receiver tank is configured to have its input and output located at the bottom of the tank. The lower half of the tank is insulated to minimize heat transfer from the machine room to the liquid refrigerant in the bottom portion of the receiver tank. The upper half of the receiver tank is exposed to the machine room ambient, preferably equivalent to no lower than 65° F. and no higher than 110° F., which allows for boiling off of refrigerant from the liquid surface; this produces a corresponding pressure equivalent to 125 psig in the receiver tank.

SUMMARY OF THE INVENTION

The present invention relates to an improved closed circuit refrigeration system including a receiver tank disposed between the remote condensers and case evaporators, and bypass means for bypassing the receiver when ambient conditions permit the remote condenser to subcool the condenser refrigerant. A bypass conduit including a temperature controlled valve provides a bypass around the receiver tank input and output; a temperature sensor senses the condenser and receiver input. When the sensed temperature is below a preselected subcooling limit, the valve is opened to provide a low resistance flow path around the receiver directly to the liquid manifold. When the sensed temperature exceeds the preselected subcooling limit, the valve is closed and the refrigerant is directed into the receiver tank to flow therethrough in normal fashion.

Another feature of the present invention is that the refrigeration system pressure delivered to the evaporators is provided by connecting the output line from the remote condenser to the evaporator input liquid manifold through a controlled valve with the connection point to the receiver input line being upstream from the controlled valve and with a hold back regulator means positioned in the receiver input line downstream from the connection point.

Still another feature of the invention resides in the use of a check valve interposed in the condenser conduit upstream of the bypass conduit to prevent backflow of refrigerant under conditions whereby the liquid manifold pressure exceeds the condenser pressure.

Still another feature of the invention resides in having the receiver tank input and output located at the bottom of the tank. The bottom half of the receiver tank is insulated while the top half of the tank is exposed to the machinery room ambient. This arrangement permits surface refrigerant to boil off to maintain adequate systems pressure between the receiver and the evaporators.

It is therefore an object of the present invention to provide a closed circuit mechanical refrigeration system in which a bypass conduit is connected between the receiver tank input and output and is opened and closed responsive to the temperature of the refrigerant flowing in the closed circuit between the condenser output and receiver input.

Another object is to provide an improvement for a closed circuit refrigeration system of the type described herein.

Yet another object of the present invention is to provide a method of operating a closed circuit refrigeration system wherein a bypass line is arranged between the receiver tank input and output and wherein the refrigerant flow in the bypass line is controlled dependent upon the temperature of the refrigerant sensed in the circuit connecting the condenser and receiver input.

BRIEF DESCRIPTION OF THE DRAWINGS

The drawing FIGURE shows a closed circuit refrigeration system incorporating the features of this invention.

DESCRIPTION OF THE PREFERRED EMBODIMENTS

The preferred embodiment of the present invention is decribed in the context of its use with a commercial refrigeration system manufactured by Tyler Refrigeration Corporation, assignee of the present invention, and sold by Tyler under the tradename "SCOTCH TWOSOME" and which commercial system is described in detail in Tyler Installation and Service Manual for Scotch Twosome Condensing Unit Assemblies REV. 5/78. In the Scotch Twosome assembly, a pair of compressors is connected in parallel, as shown, for example, in above-noted copending application Ser. No. 57,350. It should be understood, however, that the invention is not limited to the Scotch Twosome assembly; the present invention may be incorporated into and is applicable to many types of closed cycle refrigeration systems.

In a closed circuit refrigeration system of the type described herein, the "high side" refers to the high pressure side of the system (upstream of the metering device) or portion thereof. The liquid side of the system is generally considered to be between the outlet of the condenser and the metering device. The low pressure gas side or "suction side" lies between the metering device and the compressor. The metering device referred to herein is that device that controls the flow of liquid refrigerant to the evaporators.

As illustrated in the sole drawing FIGURE, the refrigeration system includes compressor means 10 connected to a main compressor discharge gas conduit 14. A solenoid operated three-way heat recovery valve 16 may be advantageously interposed in conduit 14 to selectively connect a heat recovery coil 18 in series flow relationship with a remote condenser 20. Condenser 20 advantageously includes a plurality of fans controlled by ambient conditions, as described, for example in aforementioned Ser. No. 57,350. Valve 16 connects conduit 14 to the upstream side of coil 18 through a heat recovery branch conduit 22 and to the upstream side of remote condenser 20 through a conduit 24. The downstream side of heat recovery coil 18 is connected to conduit 24, and thus remote condenser 20, by a conduit 26 containing a pressure regulator 28 and a check valve 30.

The downstream side of remote condenser 20 is connected through a conduit 32, a check valve 34, a Tee connection 36 and a holdback or upstream pressure regulator 38 to the bottom of receiver tank 40. Unlike conventional designs, the receiver tank 40 of this invention has both its inlet 42 and outlet 44 located at the bottom of the tank 40.

A receiver outlet conduit 45 is connected through a check valve 46 and a Tee connection 48 to a liquid manifold 52. One or more liquid lines 54 connect the liquid manifold 52 to each of one or more remotely located evaporators 56 associated, for example, with respective refrigerated display cases or cold rooms, generally in a store such as a supermarket. The low side of each evaporator returns to a suction manifold 58 which in turn is connected through a return line 60 to the intake of compressor means 10.

The present invention further includes a bypass line 62 coupled to Tee connections 36 and 48. A temperature operated solenoid valve 64 is interposed in bypass conduit 62 to control the flow of refrigerant therethrough as a function of the temperature of the liquid refrigerant in the conduit 32 connecting remote condenser 20 and receiver tank 40.

Liquid refrigerant from the remote condenser 20 passes through holdback regulator 38 which establishes and maintains a desired condenser head pressure, depending on such factors as the type of refrigerant used and the system ambient design conditions. From the holdback regulator 38, the liquid refrigerant flows into receiver 40 through bottom inlet 42, and flows along the bottom of the receiver to the bottom outlet 44 located at or near the opposite end of the tank from the inlet 42.

Proper operation of the closed circuit refrigeration system requires that the pressure of the refrigerant be maintained at an appropriately preselected minimum pressure level, depending on the type of refrigerant used, the operating conditions, and the size of the system. Pressure in the receiver tank 40 is maintained by a pressure regulator valve 66 interposed in a conduit 68 which connects the output of compressor 10 with the top of receiver 40. Hot gaseous refrigerant at the compressor output pressure can thus be supplied through conduit 68 and pressure regulator valve 66 to the receiver 40 whenever the pressure in the receiver tank 40 drops below a preselected level. For example, valve 66 may be set to open when the pressure in the receiver 40 drops below 120 psig for refrigerant R-502 or below 55 psig for refrigerant R-12.

The remote condenser 20 is usually located in an exterior environment exposed to outside ambient conditions, such as on the roof of a store. At certain times of the year, such as fall, winter and spring seasons, and/or in certain geographic regions, such as the northern half of the United States, the ambient temperature conditions are sufficiently low that hot gaseous refrigerant entering the remote condenser 20 is completely condensed and subcooled (below the condensing or saturation temperature for the refrigerant in use) within the condenser itself so that refrigerant flowing through conduit 32 is subcooled before entering receiver 40. The solenoid operated valve 64 senses the temperature of the subcooled liquid refrigerant flowing through conduit 32. When the sensed temperature is below a predetermined set point, again determined as a function of the type of refrigerant, size of the system, etc., valve 64 is opened to complete a low resistance refrigerant flow path from the outlet of condenser 20 through conduits 32 and 62 to the inlet side of liquid manifold 52. In this way, subcooled liquid refrigerant at the system head pressure flows directly from condenser 20 to the expansion valves or similar metering device, associated with each of the respective evaporators 56. The predetermined or preselected set point temperature can be about 60° F. so that the liquid refrigerant will pass through the receiver 40 when its temperature is above this point.

The check valve 34 located between the outlet or remote condenser 20 and the Tee connection 36 operates in conjunction with the holdback regulator 38 when receiver tank pressure is low to maintain condenser flooding, thereby assuring system head pressure and subcooling within the condenser. The check valve 34 offers a means of providing adequate head pressure for feeding the expansion valves of the respective evaporators 56.

The check valve 34 prevents refrigerant from flowing back to the condenser from the evaporators during off cycle periods of the compressors 10. It has been found that, on occasion, during off cycle periods of the compressor means 10, particularly in systems incorporating gas defrost, such as shown, for example, in U.S. Pat. No. 4,276,755, issued July 7, 1981, titled GAS DEFROST SYSTEM INCLUDING HEAT EXCHANGE, and commonly assigned with the present invention, that the refrigerant in manifold 52 will be at a higher temperature and pressure than the refrigerant in condenser 20. The design of regulator 38 is such that it has a relatively slow response time under back pressure conditions. Thus, regulator 38 will be slow to close when the refrigerant pressure on the downstream side of regulator 38 exceeds the refrigerant pressure on the upstream side thereof. A back flow condition will therefore occur for a substantial period of time whereby relatively high temperature refrigerant will flow back to condenser 20, thereby reducing its effectiveness. The check valve 34 is therefore employed to prevent such back flow from occurring during the off cycle phases of the compressor means 10.

The check valve 34 assumes added importance in connection with the present invention since, when solenoid valve 64 is held open, back flow could readily occur through bypass conduit 62, in the absence of check valve 34.

A check valve 46 connected between the receiver outlet 44 and the Tee 48 isolates the receiver tank 40 during the refrigeration mode when the bypass solenoid valve 64 is open and subcooled liquid refrigerant at the system head pressure is flowing through conduit 62 to the liquid manifold 52. Preferably and advantageously, the receiver bypass system head pressure is maintained at about 90 psig for refrigerant R-12 and about 135 psig for refrigerant R-502.

When the temperature of the condensed refrigerant rises above the range of subcooling, solenoid operated valve 64 will close and the condensed refrigerant will be directed into the receiver tank 40. This is to ensure an adequate supply of refrigerant during the condensing mode when total condensing surface is being utilized, with little or no flood back control, allowing for a reserve liquid supply (in the receiver). This is particularly useful in those systems with refrigerant control by thermostat and solenoid, requiring pump down after temperature satisfaction within the display case fixture or during defrosting of the case fixture.

Unlike conventional refrigeration systems, the present invention permits the delivery of refrigerant under pressure to the evaporators 56 by means of the connection of the condenser output line 32 to the liquid manifold 52 through the controlled valve 64. Thus refrigerant, under the above described conditions is permitted to bypass the receiver 40. The connection of the receiver inlet line 42 to condenser output conduit 32 at Tee connection 36 is upstream from valve 64 and the holdback regulator 38 is thus located downstream from that connection Tee 36.

The use of a receiver tank having both the inlet and outlet located at the bottom is based on a recognition of the fact that the receiver tank is generally located in a mechanical machine room where it is exposed to temperatures ranging between about 65° F. and about 110° F. The bottom portion of the receiver tank is covered by insulation jacket 70 to minimize heating of the subcooled liquid refrigerant flowing through the receiver tank to the higher ambient conditions in the machine room.

The terms receiver tank and receiver means as used in the specification and claims hereof include surge tanks, accumulators, holding tanks, etc., used for retaining liquid refrigerant flowing between the condenser and the liquid manifold in a closed cycle mechanical refrigeration system.

The invention may be embodied in other specific forms without departing from the spirit or essential characteristics thereof. The present embodiment is therefore to be considered in all aspects as illustrative and not restrictive, the scope of the invention being indicated by the appended claims rather than by the foregoing description, and all changes which come within the meaning and range of equivalency of the claims are therefore intended to be embraced therein.

What is claimed is:

1. A closed circuit refrigeration system, comprising:

compressor means;

condenser means coupled to the output of said compressor means;

receiver means coupled to the output of said condenser means, said receiver means adapted to maintain a preselected condenser pressure upstream to said condenser means;

evaporator means connected between the receiver means and compressor return;

bypass conduit means connected by one end between said condenser means output and the input of said receiver means and by the opposite end between the output of said receiver means and the input of said evaporator means; and means selectively controlling the flow of refrigerant through said bypass conduit means and said receiver means, respectively, as a function of the temperature of the refrigerant below its condensing temperature mesured at a point downstream of said condenser means.

2. A refrigeration system according to claim 1, wherein said selective control means includes means for sensing the temperature of refrigerant between the condenser output and the bypass conduit means and for opening said bypass conduit means to allow refrigerant to bypass said receiver means when the sensed refrigerant temperature is at or below a preselected subcooling temperature and for closing said bypass conduit to direct the flow of refrigerant to said receiver means when the sensed refrigerant temperature is above said preselected subcooling temperature.

3. A refrigeration system according to claim 2, wherein the selective control means further comprises valve means coupled with said temperature sensing means for opening and closing the refrigerant flow path through said bypass conduit means, respectively, in response to the sensed refrigerant temperature.

4. A refrigeration system according to claims 1 or 2, further comprising means for substantially preventing reverse flow of refrigerant to said condenser means when the system pressure downstream of said receiver means exceeds the pressure in said condenser means.

5. A refrigeration system according to claim 4, wherein said means for preventing reverse flow of refrigerant comprises a check valve interposed between condenser means and bypass conduit means.

6. A refrigeration system according to claim 4, wherein said receiver means comprises a receiver tank having the lower portion thereof insulated from the ambient and having its inlet and outlet located at the bottom of the tank, said inlet being coupled to the output of said condenser means and said outlet being coupled to said evaporator means.

7. A refrigeration system according to claims 1 or 3, wherein said receiver means comprises a receiver tank having the lower portion thereof insulated from the ambient and having its inlet and outlet located at the bottom of the tank, said inlet being coupled to the output of said condenser means and said outlet being coupled to said evaporator means.

8. A refrigeration system according to claim 3, wherein an inlet line for said receiver means is connected to said output of said condenser mearly at a connection point upstream from said means for selectively controlling refrigerant flow through said bypass conduit means, and wherein a holdback regulator means is positioned in said receiver means inlet line downstream from said connection point.

9. In a closed circuit refrigeration system having a compressor, a condenser means connected to the output of said compressor means, receiver means connected to the output of said condenser means, said receiver means adapted to maintain a preselected condenser pressure upstream to said condenser means, and evaporation means connected between the receiver means and the compressor return; the improvement comprising:

bypass conduit means connected between said condenser means output and the output of said receiver means; and means selectively controlling the flow of refrigerant through said bypass conduit means and said receiver means, respectively, as a function of the temperature of the refrigerant below its condensing temperature measured at a point downstream of said condenser means.

10. The improvement according to claim 9, wherein said selective control means includes means for sensing the temperature of refrigerant between the condenser output and the bypass conduit means and for opening said bypass conduit means to allow refrigerant to bypass said receiver means when the sensed refrigerant temperature is at or below a preselected subcooling temperature and for closing said bypass conduit to direct the flow of refrigerant to said receiver means when the sensed refrigerant temperature is above said preselected subcooling temperature.

11. The improvement according to claim 9, wherein said selective control means further comprises valve means coupled with said temperature sensing means for opening and closing the refrigerant flow path through said bypass conduit means, respectively, in response to the sensed refrigerant temperature.

12. The improvement according to claims 9 or 10, further comprising means for substantially preventing reverse flow of refrigerant to said condenser means when the system pressure downstream of said receiver means exceeds the pressure in said condenser means.

13. The improvement according to claims 9 or 11, wherein said receiver means comprises a receiver tank having the lower portion thereof insulated from the ambient and having its inlet and outlet located at the bottom of the tank, said inlet being coupled to the output of said condenser means and said outlet being coupled to said evaporator means.

14. The improvement according to claims 9 or 11, wherein an inlet line for said receiver means is connected to said output of said condenser means at a connection point upstream from said means for selectively controlling refrigerant flow through said bypass conduit means, and wherein a holdback regulator means is positioned in said receiver means inlet line downstream from said connection point.

15. A method of operating a closed cycle refrigeration system having a compressor, a condenser means connected to the output of the compressor means, receiver means connected to the output of the condenser means, said receiver means adapted to maintain a preselected condenser pressure upstream to said condenser means, evaporator means connected between the receiver means and the compressor return, and a selectively controlled bypass conduit means connected between the condenser means output and the output of said receiver means which has means therein for selectively controlling the flow of refrigerant, comprising the steps of:

sensing the temperature of the refrigerant below its condensing temperature in the output of the condenser means; and controlling the refrigerant flow in the bypass conduit means dependent upon the sensing of a preselected subcooled temperature in order to permit refrigerant to flow from the condenser means directly to the evaporator means under selected operation conditions.

16. The method according to claim 15, wherein said controlling step comprises the conducting of refrigerant from the condenser means directly to the evaporator means when the sensed temperature is no greater than a preselected temperature.

17. The method according to claim 16, wherein said controlling step comprises closing the bypass conduit means against the flow of refrigerant when the sensed temperature is above the preselected temperature and comprising the additional step of conducting the refrigerant flow in the output of the condenser means into the receiver means.

18. The method according to claims 16 or 17, wherein the preselected temperature is about 60° F.

19. The method according to claim 15, wherein said controlling step comprises preventing the reverse flow of refrigerant to the condenser means when the system pressure downstream of the receiver means exceeds the pressure in the condenser means.

20. The method according to claim 16, wherein a holdback regulator means is positioned between the receiver means and the connection point of receiver means and the output of the condenser means, and wherein said method comprises the additional step of establishing a predetermined refrigerant pressure in said condenser output through adjustment of the regulator means.

21. A closed circuit refrigeration system, comprising:

compressor means;

condenser means coupled to the output of said compressor means;

receiver means coupled to the output of said condenser means;

evaporator means connected between the receiver means and compressor return;

bypass conduit means connected by one end between said condenser means output and the input of said receiver means and by the opposite end between the output of said receiver means and the input of said evaporator means;

means selectively controlling the flow of refrigerant through said bypass conduit means and said receiver means, respectively, as a function of the temperature of the refrigerant below its condensing temperature measured at a point downstream of said condenser means;

a receiver means inlet line connected to the output of said condenser means at a connection point upstream from said means for selectively controlling refrigerant flow through said bypass conduit means; and a holdback regulator means positioned in said receiver means inlet line downstream from said connection point.

22. A method of operating a closed cycle refrigeration system having a compressor, a condenser means connected to the output of the compressor means, receiver means connected to the output of the condenser means, evaporator means connected between the receiver means and the compressor return, and a selectively controlled bypass conduit means connected between the condenser means output and the output of said receiver means which has means therein for selectively controlling the flow of refrigerant, and a holdback regulator means positioned between the receiver means and the connection point of the receiver means with the output of the condenser means, comprising the steps of:

sensing the condition of the refrigerant in the output of the condenser means;

controlling the refrigerant flow in the bypass conduit means dependent upon the sensing of a preselected condition in order to permit refrigerant to flow from the condenser means directly to the evaporator means under selected operating conditions, and establishing a predetermined refrigerant pressure in the condenser output through adjustment of the regulator means.

* * * * *

UNITED STATES PATENT AND TRADEMARK OFFICE

CERTIFICATE OF CORRECTION

PATENT NO. : 4,457,138

DATED : July 3, 1984

INVENTOR(S) : Edward E. Bowman

It is certified that error appears in the above-identified patent and that said Letters Patent is hereby corrected as shown below:

Column 1, line 30, change "highers" to --highest--.

Column 8, line 55, change "mearly" to --means--.

Signed and Sealed this

*Twentieth* Day of *November 1984*

[SEAL]

*Attest:*

GERALD J. MOSSINGHOFF

*Attesting Officer*

*Commissioner of Patents and Trademarks*